US008279144B2

(12) United States Patent
Zhao et al.

(10) Patent No.: US 8,279,144 B2
(45) Date of Patent: Oct. 2, 2012

(54) LED DRIVER WITH FRAME-BASED DYNAMIC POWER MANAGEMENT

(75) Inventors: Bin Zhao, Irvine, CA (US); Jack W. Cornish, Foothill Ranch, CA (US); Brian B. Horng, Irvine, CA (US); Andrew M Kameya, Irvine, CA (US); Jan Krellner, Chandler, AZ (US); Kenneth C. Kwok, Irvine, CA (US); Victor K. Lee, Irvine, CA (US); Weizhuang W. Xin, Aliso Viejo, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 1098 days.

(21) Appl. No.: 12/183,492

(22) Filed: Jul. 31, 2008

(65) Prior Publication Data

US 2010/0026203 A1 Feb. 4, 2010

(51) Int. Cl.
*G09G 3/32* (2006.01)

(52) U.S. Cl. ..... 345/82; 315/297

(58) Field of Classification Search ..... 345/39, 345/46, 82, 102; 315/185 R, 192, 294, 297, 315/308, 299
See application file for complete search history.

(56) References Cited

U.S. PATENT DOCUMENTS

| | | | |
|---|---|---|---|
| 3,973,197 | A | 8/1976 | Meyer |
| 4,162,444 | A | 7/1979 | Rodgers |
| 4,615,029 | A | 9/1986 | Hu et al. |
| 4,649,432 | A | 3/1987 | Watanabe et al. |
| 4,686,640 | A | 8/1987 | Simison |
| 5,025,176 | A | 6/1991 | Takeno |
| 5,038,055 | A | 8/1991 | Kinoshita |
| 5,455,868 | A | 10/1995 | Sergent et al. |
| 5,508,909 | A | 4/1996 | Maxwell et al. |
| 5,635,864 | A | 6/1997 | Jones |
| 5,723,950 | A | 3/1998 | Wei et al. |
| 6,002,356 | A | 12/1999 | Cooper |
| 6,281,822 | B1 | 8/2001 | Park |
| 6,373,423 | B1 | 4/2002 | Knudsen |

(Continued)

FOREIGN PATENT DOCUMENTS

JP 2003332624 A 11/2003

(Continued)

OTHER PUBLICATIONS

PCT Application No. PCT/US2010/028289; Search Report and Written Opinion dated Dec. 15, 2010.

(Continued)

*Primary Examiner* — Regina Liang

(57) ABSTRACT

Disclosed are example techniques for frame-based power management in a light emitting diode (LED) system having a plurality of LED strings. A voltage source provides an output voltage to drive the LED strings. An LED driver generates a frame timing reference representative of the frame rate or display timing of a series of image frames to be displayed via the LED system. An update reference is generated from the frame timing reference. The LED driver monitors one or more operating parameters of the LED system. In response to update triggers marked by the update reference, the LED driver adjusts the output voltage of the voltage source based on the status of each of the one or more monitored operating parameters (either from the previous update period or determined in response to the update trigger), thereby synchronizing the updating of the output voltage to the frame rate (or a virtual approximation of the frame rate) of the video being displayed.

20 Claims, 7 Drawing Sheets

U.S. PATENT DOCUMENTS

| | | | |
|---|---|---|---|
| 6,636,104 | B2 | 10/2003 | Henry |
| 6,822,403 | B2 | 11/2004 | Horiuchi et al. |
| 6,864,641 | B2 | 3/2005 | Dygert |
| 6,943,500 | B2 | 9/2005 | LeChevalier |
| 7,211,958 | B2 | 5/2007 | Maurer et al. |
| 7,262,724 | B2 | 8/2007 | Hughes et al. |
| 7,307,614 | B2 | 12/2007 | Vinn |
| 7,315,095 | B2 | 1/2008 | Kagemoto et al. |
| 7,391,280 | B2 | 6/2008 | Hsu |
| 7,436,378 | B2 | 10/2008 | Ito et al. |
| 7,459,959 | B2 | 12/2008 | Rader et al. |
| 7,511,545 | B1 | 3/2009 | Kesler |
| 7,598,686 | B2 | 10/2009 | Lys et al. |
| 7,696,915 | B2 | 4/2010 | Chmelar et al. |
| 7,777,704 | B2 | 8/2010 | S et al. |
| 7,888,888 | B2 | 2/2011 | Huang et al. |
| 7,973,495 | B2 | 7/2011 | Ion et al. |
| 2004/0208011 | A1 | 10/2004 | Horiuchi et al. |
| 2004/0233144 | A1 | 11/2004 | Rader et al. |
| 2006/0164162 | A1 | 7/2006 | Dauphinee et al. |
| 2006/0186830 | A1 | 8/2006 | Shami et al. |
| 2006/0261895 | A1 | 11/2006 | Kocaman et al. |
| 2007/0080911 | A1 | 4/2007 | Liu et al. |
| 2007/0146191 | A1 | 6/2007 | Iwata et al. |
| 2007/0253330 | A1 | 11/2007 | Tochio et al. |
| 2008/0054815 | A1 | 3/2008 | Kotikalapoodi |
| 2008/0129224 | A1 * | 6/2008 | Shih et al. |
| 2008/0143576 | A1 | 6/2008 | Chen et al. |
| 2008/0238341 | A1 * | 10/2008 | Korcharz et al. |
| 2008/0297067 | A1 | 12/2008 | Wang et al. |
| 2009/0108775 | A1 | 4/2009 | Sandner et al. |
| 2009/0128045 | A1 | 5/2009 | Szczeszynski et al. |
| 2009/0187925 | A1 | 7/2009 | Hu et al. |
| 2009/0230874 | A1 | 9/2009 | Zhao et al. |
| 2009/0230891 | A1 | 9/2009 | Zhao et al. |
| 2009/0273288 | A1 | 11/2009 | Zhao et al. |
| 2009/0315481 | A1 | 12/2009 | Zhao |
| 2010/0013395 | A1 | 1/2010 | Archibald et al. |
| 2010/0013412 | A1 | 1/2010 | Archibald et al. |
| 2010/0085295 | A1 | 4/2010 | Zhao et al. |
| 2010/0156315 | A1 | 6/2010 | Zhao et al. |

FOREIGN PATENT DOCUMENTS

| | | | |
|---|---|---|---|
| JP | 2005116199 | A | 4/2005 |
| KR | 1020070082004 | A | 8/2007 |
| WO | 2005022596 | A2 | 3/2005 |

OTHER PUBLICATIONS

Notice of Allowance mailed Apr. 7, 2011 for U.S. Appl. No. 12/326,963, 20 pages.
Non-Final Office Action mailed Apr. 19, 2011 for U.S. Appl. No. 12/363,294, 19 pages.
Non-Final Office Action mailed Apr. 19, 2011 for U.S. Appl. No. 12/363,607, 17 pages.
Mc Nerney, Tim, "Constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.
MAXIM: "Application Note 810, Understanding Flash ADCs," Oct. 2, 2001, 8 pages.
National Semiconductor Data Sheet: "LM3432/LM3432B 6-Channel Current Regulator for LED Backlight Application," May 22, 2008, pp. 1-18.
U.S. Appl. No. 12/537,443, filed Aug. 7, 2009, entitled Pulse Width Modulation Frequency Conversion.
U.S. Appl. No. 12/703,239, filed Feb. 10, 2010, entitled "Pulse Width Modulation With Effective High Duty Resolution".
U.S. Appl. No. 12/537,692, filed Aug. 7, 2009, entitled "Phase-Shifted Pulse Width Modulation Signal Generation".
U.S. Appl. No. 12/625,818, filed Nov. 25, 2009, entitled "Synchronized Phase-Shifted Pulse Width Modulation Signal Generation".
U.S. Appl. No. 12/703,249, filed Feb. 10, 2010, entitled "Duty Transition Control in Pulse Width Modulation Signaling".
Luke Huiyong Chung, Electronic Products: "Driver ICs for LED BLUs," May 1, 2008, 3 pages.
Akira Takahashi, Electronic Products: "Methods and features of LED drivers," Mar. 2008, 3 pages.
U.S. Appl. No. 12/340,985, filed Dec. 22, 2008, entitled "LED Driver With Feedback Calibration".
U.S. Appl. No. 12/326,963, filed Dec. 3, 2008, entitled "LED Driver With Precharge and Track/Hold".
U.S. Appl. No. 12/367,672, filed Feb. 9, 2009, entitled "Configuration for Dynamic Power Control in LED Displays".
U.S. Appl. No. 12/424,326, filed Apr. 15, 2009, entitled "Peak Detection With Digital Conversion".
U.S. Appl. No. 12/504,841, filed Jul. 17, 2009, entitled "Analog-To-Digital Converter With Non-Uniform Accuracy".
U.S. Appl. No. 12/690,972, filed Jan. 21, 2010, entitled "Serial Cascade of Minimum Tail Voltages of Subsets of LED Strings for Dynamic Power Contrl in LED Displays".
U.S. Appl. No. 12/363,607, filed Jan. 30, 2009, entitled "LED Driver With Dynamic Headroom Control".
International Application No. PCT/US2009/035284, Search Report and Written Opinion, Oct. 28, 2009, 11 pages.
Texas Instruments Publication, "Interleaved Dual PWM Controller with Programmable Max Duty Cycle," SLUS544A, Sep. 2003, pp. 1-28.
Notice of Allowance mailed Jun. 21, 2011 for U.S. Appl. No. 12/340,985, 27 pages.
Non-Final Office Action mailed May 4, 2011 for U.S. Appl. No. 12/367,672, 26 pages.
Notice of Allowance mailed Jul. 19, 2011 for U.S. Appl. No. 12/424,326, 27 pages.
Notice of Allowance mailed Aug. 1, 2011 for U.S. Appl. No. 12/363,294, 11 pages.
Ex parte Quayle mailed Jul. 20, 2011 for U.S. Appl. No. 12/363,179, 25 pages.
Notice of Allowance mailed Aug. 11, 2011 for U.S. Appl. No. 12/363,607, 9 pages.
Office Action—NFOA Feb. 4, 2010, 11 pages.
Office Action—NOA Jun. 2, 2010, 7 pages.
Office Action—NOA Jul. 9, 2010, 12 pages.
International App. No. PCT/US2009/065913, Search Report mailed Jul. 7, 2010, 4 pages.
Notice of Allowance mailed Sep. 27, 2011 for U.S. Appl. No. 12/504,335, 35 pages.
Final Office Action mailed Oct. 20, 2011 for U.S. Appl. No. 12/367,672, 24 pages.
Notice of Allowance mailed Jan. 9, 2012 for U.S. Appl. No. 12/367,672, filed Feb. 9, 2009, entitled "Serial Configuration for Dynamic Power Control in LED Displays" , 14 pages.
Notice of Allowance mailed Dec. 14, 2011 for U.S. Appl. No. 12/363,179, filed Jan. 30, 2009, entitled "LED Driver With Segmented Dynamic Headroom Control", 14 pages.
Non-Final Office Action mailed Mar. 13, 2012 for U.S. Appl. No. 12/504,841, filed Jul. 17, 2009, 38 pages.

* cited by examiner

LED DRIVER WITH FRAME-BASED DYNAMIC POWER MANAGEMENT

FIELD OF THE DISCLOSURE

The present disclosure relates generally to light emitting diode (LED) displays and more particularly to LED drivers for LED displays.

BACKGROUND

Light emitting diodes (LEDs) often are used for backlighting sources in liquid crystal displays (LCDs), direct LED displays, and other displays. In LED display implementations, the LEDs are arranged in parallel "strings" driven by a shared output voltage, each LED string having a plurality of LEDs connected in series. During operation, conventional LED drivers typically continuously adjust the output voltage to compensate for changes in certain monitored characteristics of the LED system. This continual adjustment often is conducted in a manner such that any given change in the output voltage does not have a chance to settle in the LED system before the output voltage is changed yet again, thereby leading to instability in the LED system.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-11 illustrate example techniques for frame-based power management in a light emitting diode (LED) system having a plurality of LED strings. A voltage source provides an output voltage to drive the LED strings. An LED driver generates a frame timing reference representative of the frame rate and display timing of a series of image frames to be displayed via the LED system. An update reference is generated from the frame timing reference as a harmonic or sub-harmonic of the frame rate of the frame timing reference, or with some selected sub-set of the frame-related signals of the frame timing reference. The LED driver monitors one or more operating parameters of the LED system. In response to update triggers marked by the update reference, the LED driver adjusts the output voltage of the voltage source based on the status of each of the one or more monitored operating parameters (either from the previous update period or determined in response to the update trigger), thereby synchronizing the updating of the output voltage to the frame rate of the video being displayed. FIGS. 6-11 illustrate particular embodiments whereby an operating parameter being monitored for periodic updates to the output voltage includes the minimum, or lowest, tail voltage of the plurality of LED strings.

The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string. The term "tail voltage," as used herein, refers the voltage at the tail end of a LED string or representation thereof (e.g., a voltage-divided representation, an amplified representation, etc.).

Figure 1:
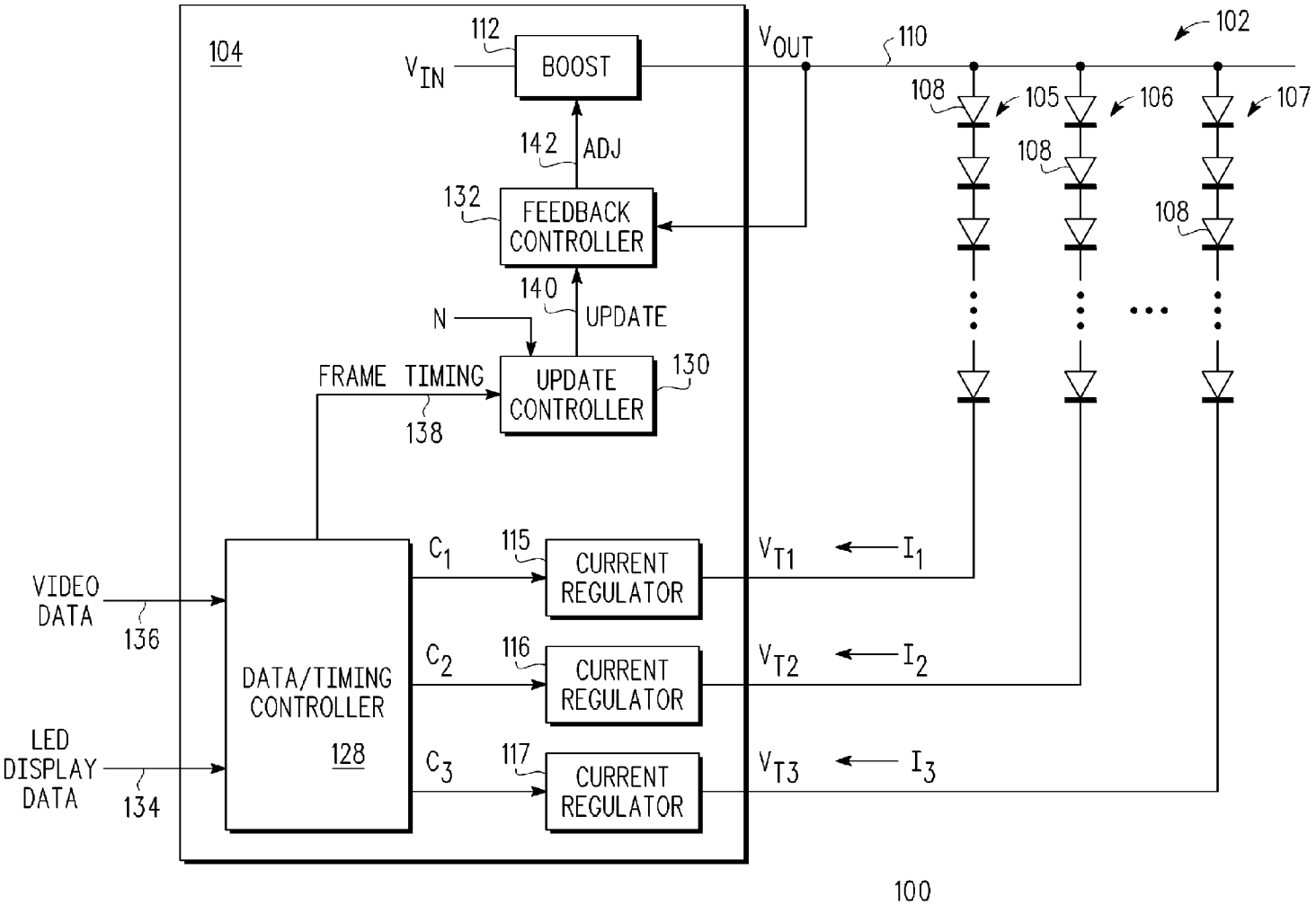
FIG. 1 is a diagram illustrating a light emitting diode (LED) system having frame-based dynamic power management in accordance with at least one embodiment of the present disclosure.

FIG. 1 illustrates a LED system 100 having frame-based dynamic power management in accordance with at least one embodiment of the present disclosure. In the depicted example, the LED system 100 includes a LED panel 102, a LED driver 104, and a voltage source 112 for providing an output voltage $V_{OUT}$ to drive the LED panel 102. The LED panel 102 includes a plurality of LED strings (e.g., LED strings 105, 106, and 107). Each LED string includes one or more LEDs 108 connected in series and each LED string is driven by the adjustable voltage $V_{OUT}$ received at the head end of the LED string via a voltage bus 110 (e.g., a conductive trace, wire, etc.). The LEDs 108 can include, for example, white LEDs, red, green, blue (RGB) LEDs, organic LEDs (OLEDs), etc. In the embodiment of FIG. 1, the voltage source 112 is implemented as a boost converter configured to drive the output voltage $V_{OUT}$ using an input voltage $V_{IN}$. The voltage source 112 also can be implemented as a step-down buck converter, a buck-boost converter, charge pump converter, and the like. Further, as illustrated, the voltage source 112 can be implemented, in whole or in part, at the LED driver 104, or the voltage source 112 can be implemented separate from the LED driver.

The LED driver 104, in at least one embodiment, is configured to control the voltage source 112 so as to provide the output voltage $V_{OUT}$ at a magnitude sufficient to meet predetermined criteria for one or more operating parameters of the LED system 100, such as maintaining a minimum tail voltage of the tail voltages $V_{T1}$, $V_{T2}$, and $V_{T3}$ of LED strings 105-107, respectively, at, near, or below a predetermined threshold, maintaining the output voltage $V_{OUT}$ at or near a predetermined voltage level, etc. Further, in at least one embodiment, the LED driver 104 is configured to maintain the current flowing through the each of the LED strings 105-107 at or near a predetermined current level when the LED string is activated.

In the depicted example, the LED driver 104 includes a plurality of current regulators (e.g., current regulators 115, 116, and 117), a data/timing controller 128, an update controller 130, and a feedback controller 132. In the example of FIG. 1, the current regulator 115 is configured to maintain the current $I_1$ flowing through the LED string 105 at or near a targeted current (e.g., 30 mA) when active. Likewise, the current regulator 116 is configured to maintain the current $I_2$ flowing through the LED string 106 when active at or near a targeted current and the current regulator 117 is configured to maintain the current $I_3$ flowing through the LED string 107 when active at or near a targeted current.

The data/timing control module 128 is configured to receive LED display data 134 and video data 136 associated with video information to be displayed at a display device (not shown) implementing the LED panel 102, whereby the video information comprises a series of image frames to be displayed at an indicated frame rate. The LED display data 134 can include, for example, LED current level data that controls the current level in each of the LED strings 105-107 as a function of time. Alternately, the LED display data 134 can include pulse width modulation (PWM) data that indicates which of the LED strings 105-107 are to be activated and at what times during a corresponding PWM cycle, in response to which the LED driver 104 is configured to individually activate the LED strings 105-107 at the appropriate times in their respective PWM cycles. Accordingly, the data/timing controller 128 is configured to provide control signals to the other components of the LED driver 104 based on the timing and activation information represented by the LED display data 134. To illustrate, the data/timing control module 128 provides control signals $C_1$, $C_2$, and $C_3$ to control which of the LED strings 105-107 are active during corresponding portions of their respective PWM cycles. Although FIG. 1 illustrates an example embodiment whereby the LED display data 134 is received separate from the video data 136, in an alternate embodiment, the data/timing control module 128 can determine the LED display data 134 from the video data 136.

The video data 136 includes frame information indicating timing of the display of the image frames (e.g., indicating the start of the display of each image frame). Examples of the frame information can include, for example, the vertical synchronization (VSYNC) signaling provided in National Television Standards Committee (NTSC)-based systems, Phase Alternating Line (PAL)-based systems, and High Definition Television (HDTV)-based systems, the Vertical Blanking Interface (VBI) utilized in a Visual Graphics Array (VGA) or Digital Video Interface (DVI)-based system. Other signaling associated with frame changes can be used without departing from the scope of the present disclosure. In at least one embodiment, the data/timing controller 128 utilizes the frame rate information implemented in the video data 136 to provide a frame timing reference 138, whereby the frame timing reference 138 comprises digital or analog signaling identifying the timing of the start of the display of each image frame at the display device having the LED panel 102.

The update controller 130 is configured to utilize the frame timing reference 138 to control the timing of the updating or adjustment of output voltage $V_{OUT}$ provided by the voltage source 112. In at least one embodiment, the update controller 130 generates an update reference 140 based on the frame timing reference 138, whereby the update reference 140 can be a harmonic of the frame rate (FR) represented by the frame timing reference 138 (e.g., FR*N, whereby N is an integer), the update reference 140 can be a subharmonic of the frame rate (e.g., FR/N), or the update reference 140 be equal to the frame timing reference 138 (e.g., whereby the update controller 130 passes the frame timing reference 138 through as the update reference 140 without modification or whereby the feedback controller 132 utilizes the frame timing reference 138 directly rather than utilizing the update reference 140 generated based on the frame timing reference 138). The harmonic variable N utilized to generate the update reference 140 as a harmonic or subharmonic of the frame timing reference 138 can be obtained in any of a variety of ways. To illustrate, the harmonic variable N can be stored and accessed from a register or non-volatile memory (e.g., a flash memory), the harmonic variable N can be generated from a digitization of a voltage generated via a resistor (e.g., an external resistor having an adjustable resistance so as to permit programming of the harmonic variable N), and the like. In another embodiment, the update controller 130 generates the update reference 140 from a non-harmonic subset of the frame rate represented by the frame timing reference 138 by utilizing a predefined selection algorithm or selection pattern determined by, for example, a condition at the feedback controller 132 or the previous update history. For example, the update controller 130 can use a selection pattern, represented as FR*N/C, so as to select every Cth update trigger generated by the harmonic FR*N. To illustrate, the update controller 130 can generate a reference signal having a frequency of FR*2 (i.e., N=2) and then count every third (i.e., C=3) cycle of the reference signal to generate the corresponding update reference 140.

In yet another embodiment, the update controller 130, rather than using the frame timing reference 138, can instead generate the update reference 140 via generation of a virtual frame timing reference that represents a virtual frame rate that serves as an approximation of the expected frame rate of the video data. To illustrate, in one embodiment, the update controller 130 can generate the update reference 140 through information in the video data 136 in real time. In another embodiment, the update controller 130 can implement a virtual frame timing reference source, such as an oscillator, a phase locked loop (PLL) or other clocking source, to generate a clock signal that has a fixed frequency approximately equal to or otherwise based on the fastest expected frame rate for the video data 136, and this clock signal can be provided as the update reference 140. In one embodiment, the fixed frequency can be dynamically changed to accommodate for frame rate changes by, for example, a source of the video data 136 (e.g., a digital signal processor (DSP)) by, for example, writing a value associated with a particular frame rate to a register associated with the clock source.

The feedback controller 132 is configured to receive the update reference 140 and to provide an adjustment signal ADJ (also identified as signal 142 in FIG. 1) responsive to the update reference 140, whereby the adjustment signal ADJ is configured to control the voltage source 112 to adjust the output voltage $V_{OUT}$. As described in greater detail herein, the feedback controller 132 is configured to initiate an update process in response to update triggers in the update reference 140, whereby the update process comprises determining an actual state for each of one or more operating parameters of the LED system 100, determining the relationship between the actual state and a target state for a given operating parameter, and configuring the adjustment signal ADJ to adjust the output voltage $V_{OUT}$ accordingly. In one embodiment, the feedback controller 132 receives the tail voltages $V_{T1}$, $V_{T2}$, and $V_{T3}$ of LED strings 105-107, and the considered operating parameter includes a minimum tail voltage of the LED strings 105-107, which is compared to a tail voltage threshold to determine whether to increase or decrease the output voltage $V_{OUT}$. In another embodiment, a considered operating parameter is the magnitude of the output voltage $V_{OUT}$ itself, which is compared with a target magnitude for the output voltage $V_{OUT}$ to determine whether to increase or decrease the level of the output voltage $V_{OUT}$.

In one embodiment, the feedback controller 132 initiates the update process in response to each update trigger in the update reference 140. In an alternate embodiment, the feedback controller 132 uses additional criteria to determine whether to initiate the update process in response to an update trigger. A previous adjustment to the output voltage $V_{OUT}$ may take considerable time to settle throughout the LED system 100, particularly in the case of an increase in the output voltage $V_{OUT}$ and thus the operating parameters affected by the magnitude of the output voltage $V_{OUT}$ typically will not be reliable indicators of whether further adjustment is necessary until the output voltage $V_{OUT}$ is settled. Accordingly, in at least one embodiment, the feedback controller 132 maintains an update history of the last update made to the output voltage $V_{OUT}$ and monitors the output voltage $V_{OUT}$ to determine whether the output voltage $V_{OUT}$ has settled to the target voltage. If the output voltage has not sufficiently settled, the feedback controller 132 may disregard an update trigger in the update reference 140 so as to avoid further adjustment to the output voltage $V_{OUT}$. The feedback controller 132 can determine whether the output voltage $V_{OUT}$ is sufficiently settled based on the manner in which the feedback controller 132 uses the operating parameters to update the output voltage $V_{OUT}$.

To illustrate, if the feedback controller 132 uses, for example, the instantaneous minimum tail voltage of the tail voltages of the LED strings 105-107 at the time of the update trigger, then the output voltage $V_{OUT}$ typically would be considered to be sufficiently settled if it settles to the target magnitude before the update trigger occurs. In contrast, if the feedback controller 132 uses, for example, the minimum tail voltage of the tail voltages of the LED strings 105-107 of the duration of a frame as the operating parameter and the last update to the output voltage $V_{OUT}$ resulted in an increase in magnitude of the output voltage $V_{OUT}$, it may not be sufficient for the output voltage to settle for only part of a frame duration to use the minimum tail voltage over that frame duration. That is, the detected minimum tail voltage detected during this only partially-settled frame duration may not be accurate indicators of the state of the LED strings 105-107 with the targeted magnitude for the output voltage $V_{OUT}$ implemented. Thus, in this situation the feedback controller 132 would wait until the next update trigger before initiating the update process so to determine the minimum tail voltage over the next frame duration whereby the output voltage $V_{OUT}$ is settled for the full duration.

Figure 2:
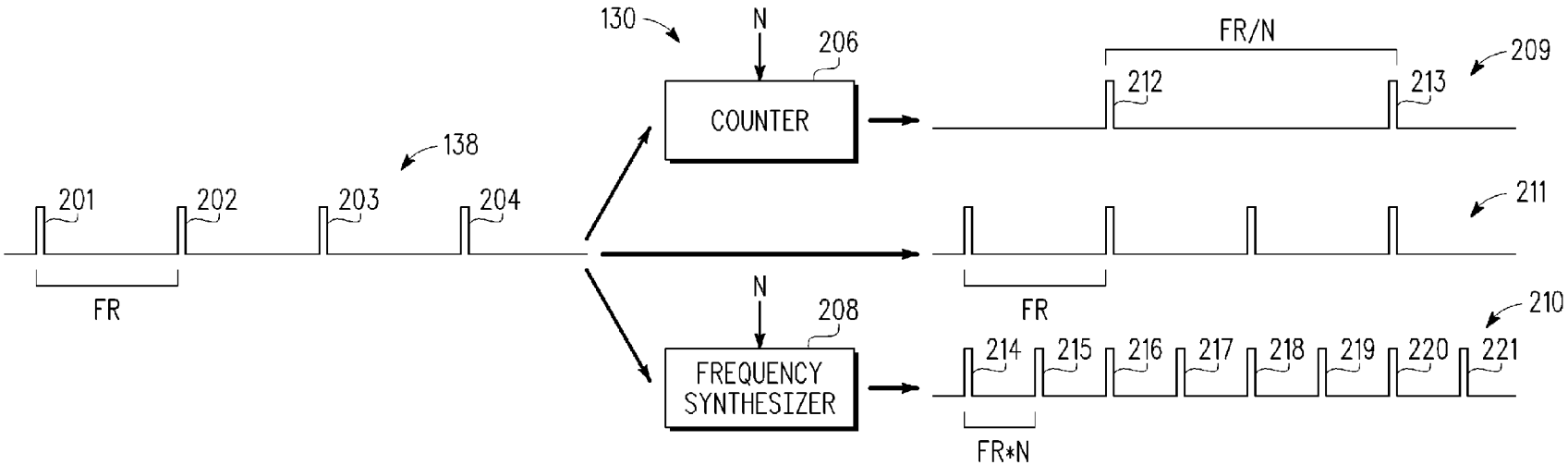
FIG. 2 is a diagram illustrating various examples for generating an update reference from a frame timing reference in the LED system of FIG. 1 in accordance with at least one embodiment of the present disclosure.

FIG. 2 illustrates an example implementation of the update controller 130 in accordance with at least one embodiment of the present disclosure. As discussed above, the update controller 130 generates an update reference 140 as either a harmonic or subharmonic of the frame timing reference 138 or the update controller 130 provides the frame timing reference 138 directly as the update reference 140. Alternately, the update controller 130 can generate the update reference 140 based on an aperiodic subset of the frame changes indicated in the frame timing reference 138. In the depicted example, the frame timing reference 138 is represented as a series of pulses (e.g., pulses 201-204), each pulse corresponding to the start of the display of a corresponding image frame.

To generate the update reference 140 as a subharmonic of the frame timing reference 138, the update controller 130 can include, for example, a counter 206 that has an input to receive the harmonic variable N, an input to receive the frame timing reference 138, and an output to provide an update reference 209 (one example of the output reference 140) having a frequency of FR/N by, for example, asserting (e.g., pulsing) the update reference 209 for every N pulses detected in the frame reference 138. In the example of FIG. 2, the harmonic variable N is set to two (2), and thus the counter 206 generates the update reference 209 as having two pulses (e.g., pulses 212 and 213) for the illustrated four pulses 201-204 of the frame timing reference 138. To generate the update reference 140 as a harmonic of the frame timing reference 138, the update controller 130 can include, for example, a frequency synthesizer 208 that has an input to receive the harmonic variable N, an input to receive the frame timing reference 138, and an output to provide an update reference 210 (another example of the update reference 140) having a frequency of N*FR. As illustrated, with the harmonic variable N set to two (2), the frequency synthesizer 208 generates the update reference 210 as having eight pulses (e.g., pulses 214-221) for the illustrated four pulses 201-204 of the frame timing reference 138. Further, to provide the update reference 140 as representing the frame rate of the video without modification, the update controller 130 can be bypassed or omitted and the frame timing reference 138 can be provided without modification as an update reference 211 (another example of the update reference 140) to the feedback controller 132. As also described above, instead of using the frame timing information in the video data 136, the update controller 130 instead can generate the update reference 140 based on a virtual frame timing reference, such as a generated clock signal having a frequency approximately equal to an expected frame rate of the video data 136.

As illustrated by FIG. 2, the update reference 140 defines update triggers marked by assertions (e.g., pulses or other voltage level changes) in the update reference 140. As described below, these update triggers are utilized to control the initiation of an update process for adjusting the output voltage $V_{OUT}$. As the pulses 201-204 of the frame timing reference 138 represent the start (or the end) of each frame in a series of frames associated with the video data (e.g., frames 1, 2, 3, and 4), the update triggers can be initiated at the start of selected frames of a set of contiguous image frames of the series, as illustrated by the update reference 211. Alternately, as illustrated by the update reference 209, the update triggers can be initiated at the start of each of a set of discontiguous image frames of the series (e.g., at the start of every alternate frame (frames 2 and 4), every third image frame, etc.). Alternately, the update triggers can be implemented at a harmonic of the frame rate (FR*N) as illustrated by the update reference 210, or the update triggers can be implemented in accordance with a predetermined selection scheme that takes into account both the frame timing and a status of the feedback controller 132 (e.g., whether it updated the output voltage $V_{OUT}$ in the previous update period).

Figure 3:
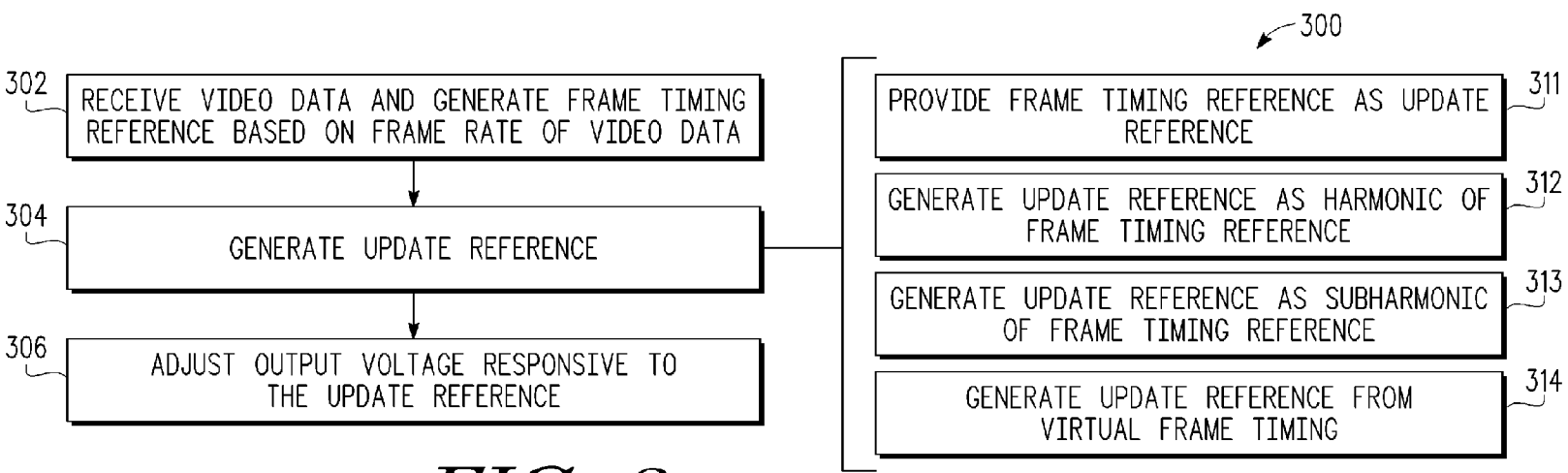
FIG. 3 is a flow diagram illustrating an example method of operation of the LED system of FIG. 1 in accordance with at least one embodiment of the present disclosure.

FIG. 3 illustrates an example method 300 of operation of the LED system 100 of FIG. 1 in accordance with at least one embodiment of the present disclosure. Although FIG. 3 illustrates a series of discrete blocks 302, 304, and 306 for ease of discussion, the method 300 is a continuous process whereby the processes represented by each of the blocks are performed substantially concurrently.

At block 302, the data/timing controller 128 of the LED driver 104 receives the video data 136 and generates the frame timing reference 138 from the video data 136 based on the frame rate of the series of image frames associated with the video data 136. As discussed above, the frame timing reference 138 can include, for example, signaling representative of the VSYNC timing in the video data 136, where each occurrence of a VSYNC signal in the video data 136 is represented by a corresponding pulse or other voltage level change in the frame timing reference 138.

At block 304, the update controller 130 generates the update reference 140 from the frame timing reference 138 as the frame timing reference 138 is being generated by the data/timing controller 128. As illustrated, the generation of the update reference 140 can include a pass-through process 311 whereby the frame timing reference 138 is directly provided as the update reference 140 so that the update reference 140 has a frequency and timing equal to the frame rate of the video data 136. Alternately, the generation of the update reference 140 can include a subharmonic process 312 whereby the update controller 130 uses a counter 206 (FIG. 2) or other mechanism to generate the update triggers in the update reference 140 with a frequency that is 1/N of the frame rate FR of the video data 136 (i.e., equal to FR/N, N being an integer). As another example, the generation of the update reference 140 can include a harmonic process 313 whereby the update controller 130 uses a frequency synthesizer 208 (FIG. 2) or other mechanism to generate the update triggers in the update reference 140 with a frequency that is an integer N times the frame rate FR of the video data 136 (i.e., equal to FR*N). As another alternate process, rather than using the actual frame timing reference 138, the generation of the update reference 140 can include a virtual timing process 314 whereby the update controller 130 uses a clock source to generate a virtual timing reference representative of the expected frame rate of the video data 136 and then generates the update reference 140 from this virtual frame timing reference (e.g., as a harmonic or subharmonic of the virtual frame rate represented by the virtual timing reference, or the virtual timing reference is provided directly as the update reference 140).

At block 306, the feedback controller 132 adjusts the output voltage $V_{OUT}$ responsive to the update reference 140 as the update reference 140 is generated by the update controller 130. The feedback controller 132 can adjust the output voltage $V_{OUT}$ by controlling the voltage source 112 via the adjust signal ADJ. As described herein, the feedback controller 132 uses the update triggers (e.g., pulses or other assertion features) present in the update reference 140 to initiate adjustment of the output voltage $V_{OUT}$ based on an assessment of one or more operating parameters of the LED system 100 related to the output voltage $V_{OUT}$. As also discussed herein, the initiation of the update process also may be controlled by the update history and the current settling status of the output voltage $V_{OUT}$.

Figure 4:
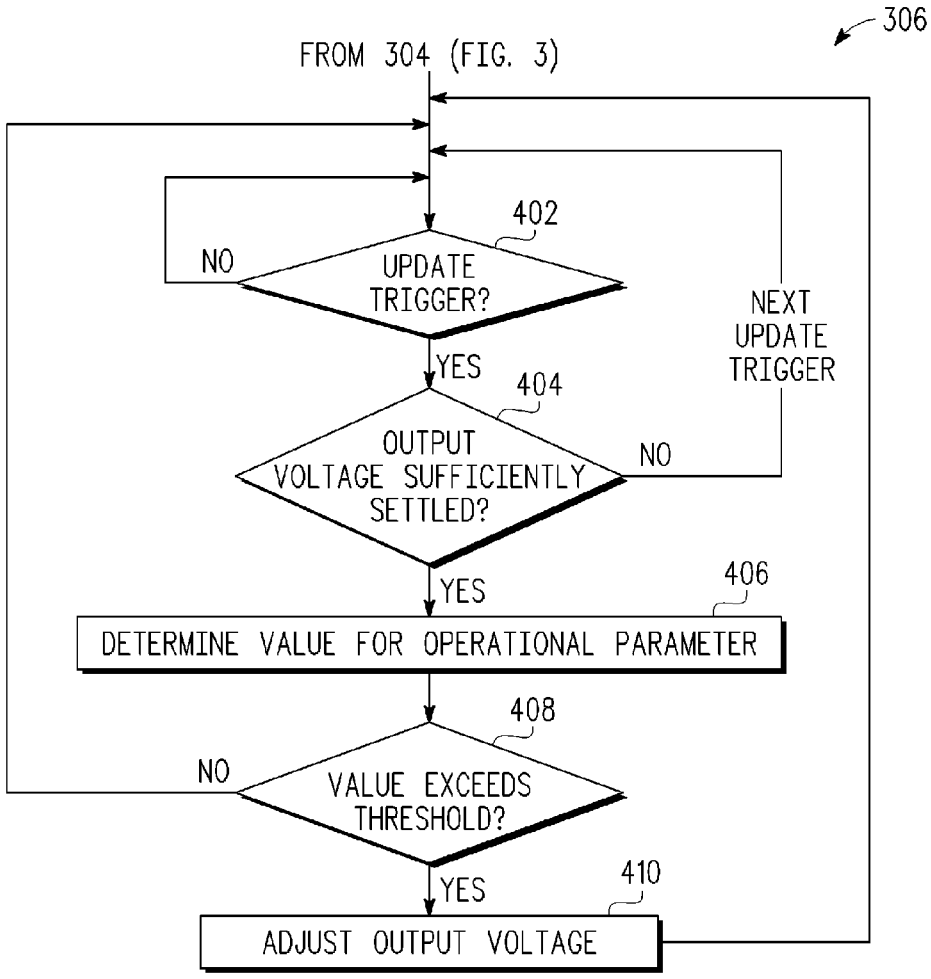
FIG. 4 is a flow diagram illustrating a particular process of FIG. 3 in greater detail in accordance with at least one embodiment of the present disclosure.

FIG. 4 illustrates an example implementation of the process of block 306 of method 300 of FIG. 3 in accordance with at least one embodiment of the present disclosure. At block 402, the feedback controller 132 analyzes the update reference 140 as it is being received from the update controller 130. In the event that the feedback controller 132 detects that the update reference 140 has been asserted (e.g., a pulse or other voltage level change is detected in the update reference 140), at block 404 the feedback controller 132 determines its update history of the last adjustment to the output voltage $V_{OUT}$ and further determines whether the output voltage $V_{OUT}$ has sufficiently settled after the adjustment. To illustrate, if the adjustment involved an increase in the magnitude of the output voltage $V_{OUT}$ and the monitored operational parameter of the LED system 100 comprises the minimum tail voltage of the LED strings 105-107 (FIG. 1) over an entire frame, then the output voltage $V_{OUT}$ may only be deemed to be sufficiently settled once it has settled at or sufficiently near the target magnitude for an entire frame. Alternately, if the adjustment involves a decrease in the magnitude of the output voltage $V_{OUT}$, or if the monitored operational parameter is the instantaneous minimum tail voltage of the LED strings 105-107 at the time of the update trigger, the feedback controller 132 may deem the output voltage $V_{OUT}$ to be sufficiently settled in the event that it is at or sufficiently near the target magnitude at the time that the instantaneous minimum tail voltage is determined.

If the output voltage $V_{OUT}$ is not sufficiently settled, the feedback controller 132 disregards the update trigger and the process returns to block 402 whereby the feedback controller 132 waits for the next update trigger before initiating the update process so as to allow the output voltage $V_{OUT}$ to become sufficiently settled. Otherwise, if the feedback controller 132 deems the output voltage $V_{OUT}$ to be sufficiently settled by the time of the update trigger, at block 406 the feedback controller 132 analyzes the operational parameter of the LED system 100 to determine a value representative of the current status of the operational parameter. As described in greater detail herein, the operational parameter can include, for example, the instantaneous minimum tail voltage of the tail voltages ($V_{T1}$, $V_{T2}$, $V_{T3}$) of the LED strings 105-107 (FIG. 1) at the time that the update trigger of the update reference 402 is detected or the minimum tail voltage of the tail voltages of the LED strings 105-107 for the period between the immediately previous update trigger of the update reference 140 and the currently detected update trigger of the update reference 140. As another example, the operating parameter can include the magnitude of the output voltage $V_{OUT}$, either at the time of the currently detected update trigger of the update reference 140 or as a minimum or maximum magnitude for the period between the previous and current update triggers of the update reference 140.

At block 408, the feedback controller 132 determines whether the determined status of the operating parameter exceeds a predetermined threshold associated with the operating parameter. To illustrate, if the operating parameter pertains to the minimum tail voltage of the LED strings 105-107, the predetermined threshold could be a target voltage level (e.g., 0.5 V) or target voltage level range (e.g., 0.4V to 0.6 V) for the minimum tail voltage of the LED strings 105-107, which could be exceeded if the minimum tail voltage falls below or falls above the target voltage level or target voltage level range. As another example, if the operating parameter pertains to the magnitude of the output voltage $V_{OUT}$, the predetermined threshold could be a target voltage level (e.g., 50 V) or a target voltage level range (e.g. 48 V to 52 V) for the output voltage $V_{OUT}$.

In the event that the value representative of the current status of the operating parameter exceeds the corresponding threshold (e.g., falls above a maximum threshold or falls below a minimum threshold), at block 410 the feedback controller 132 configures the adjustment signal ADJ so as to direct the voltage source 112 to adjust the output voltage $V_{OUT}$ accordingly. To illustrate, if the minimum tail voltage is determined to fall below the tail voltage threshold range, the feedback controller 132 would direct the voltage source 112 to increase the output voltage $V_{OUT}$ so as to raise the minimum tail voltage. Conversely, if the minimum tail voltage is determined to fall above the tail voltage threshold range, the feedback controller 132 would direct the voltage source 112 to decrease the output voltage $V_{OUT}$ so as to decrease the minimum tail voltage.

Figure 5:
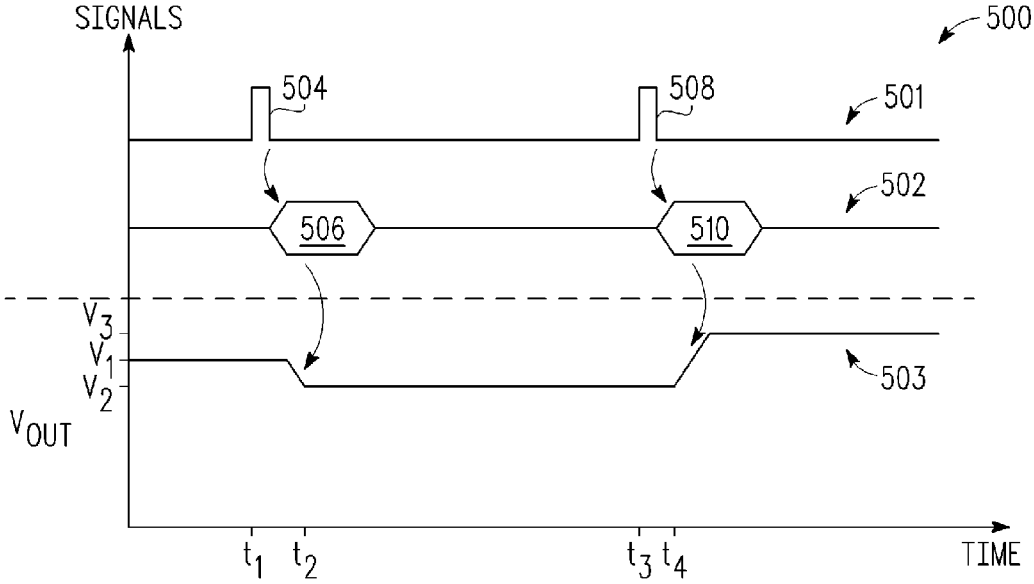
FIG. 5 is a chart illustrating an example of a frame-based power management process in accordance with at least one embodiment of the present disclosure.

FIG. 5 illustrates a chart 500 describing an example operation of the frame-based dynamic power management process implemented by the LED system 100 in accordance with at least one embodiment of the present disclosure. The chart 500 includes a line 501 representative of an example of the update reference 140 (FIG. 1), a line 502 representative of the frame-based power management process, and a line 503 representative of the magnitude of the output voltage $V_{OUT}$. For the example of FIG. 5, it is assumed that the update reference 140 has a frequency equal to the frame rate of the video data 136 (FIG. 1) such that the update reference 140 includes update triggers (e.g., pulses) synchronized to the start of the display of each image frame. It is also assumed for ease of illustration that any adjustment to the output voltage $V_{OUT}$ in response to one update trigger is deemed to be sufficiently settled by the next update trigger.

At time $t_1$, an image frame is output for display and thus the update reference 140 is configured to include a pulse 504 as an update trigger. In response to the pulse 504 and in response to determining the output voltage $V_{OUT}$ is sufficiently settled, the feedback controller 132 initiates an update process 506 for the output voltage $V_{OUT}$ by determining the status of one or more operating parameters and adjusting the output voltage $V_{OUT}$ accordingly. In the example of FIG. 5, this adjustment results in a decrease in the magnitude of the output voltage from a voltage $V_1$ to a voltage $V_2$ at time $t_2$, whereby the output voltage $V_{OUT}$ is maintained at this magnitude until the start of the display of the next image frame. At time $t_3$, the next image frame is output for display and thus the update reference 140 is configured to include a pulse 508 as an update trigger. In response to the pulse 508 and in response to determining that the output voltage $V_{OUT}$ is sufficiently settled at the voltage $V_2$, the feedback controller 132 initiates an update process 510 for the output voltage $V_{OUT}$ by again determining the status of one or more operating parameters and adjusting the output voltage $V_{OUT}$ accordingly. In the example of FIG. 5, this second adjustment results in an increase in the magnitude of the output voltage from the voltage $V_2$ to a voltage $V_3$ at time $t_4$, whereby the output voltage $V_{OUT}$ is maintained at this magnitude until the start of the display of the next image frame.

As illustrated by FIG. 5, the LED driver 104 adjusts the output voltage $V_{OUT}$ based at least partially on the frame rate of the video data 136 rather than continuously adjusting the output voltage $V_{OUT}$. By synchronizing the update process to the frame rate, the adjustment to the output voltage can be determined, implemented, and allowed to settle for a sufficient time before the next adjustment is initiated. Further, because the displayed image, and thus the activated LED strings, remains constant for the duration of the display of the image frame, the characteristics of the LED system are unlikely to vary significantly during any frame-synchronized update period, and therefore the characteristics of the LED system is unlikely to substantially change between the frame-based updates. Moreover, as discussed above, the feedback controller 132 may disregard one or more adjustment triggers if the previous adjustment to the output voltage $V_{OUT}$ is deemed to be insufficiently settled, and thereby avoiding making further adjustments to the output voltage $V_{OUT}$ based on operational parameters that may not accurately reflect the state of the LED system 100. Thus, the frame-based update process as described herein can reduce or eliminate the instability that often is a result of the continual adjustments to the output voltage as conducted by conventional LED systems.

Figure 6:
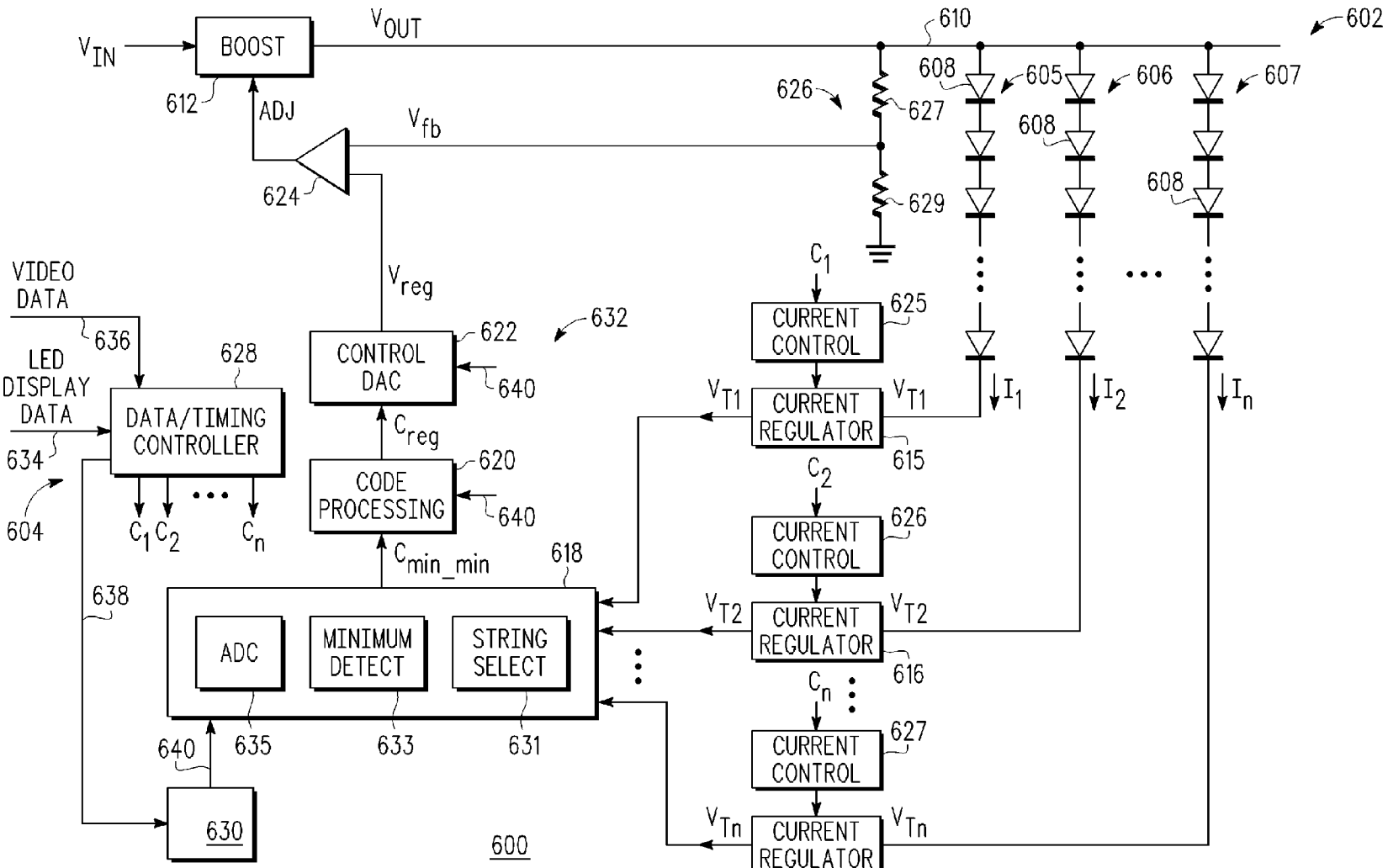
FIG. 6 is a diagram illustrating a particular implementation of the LED system of FIG. 1 in accordance with at least one embodiment of the present disclosure.

FIGS. 6-11 illustrate a particular implementation of the frame-based dynamic power management process using minimum tail voltages as the operating parameter for adjusting the output voltage $V_{OUT}$. FIG. 6 illustrates a LED system 600 (corresponding to the LED system 100) that includes a LED panel 602, a LED driver 604, and a voltage source 612 for providing an output voltage $V_{OUT}$ to drive the LED panel 602. The LED panel 602 includes a plurality of LED strings (e.g., LED strings 605, 606, and 607). Each LED string includes one or more LEDs 608 connected in series and each LED string is driven by the adjustable voltage $V_{OUT}$ received at the head end of the LED string via a voltage bus 610 (e.g., a conductive trace, wire, etc.).

The LED driver 604 includes a data/timing controller 628 (corresponding to the data/timing controller 138, FIG. 1), an update controller 630 (corresponding to the update controller 130, FIG. 1), and a feedback controller 632 (corresponding to the feedback controller 132, FIG. 1) configured to control the voltage source 612 based on the tail voltages at the tail ends of the LED strings 605-607. As described in greater detail below, the LED driver 604, in one embodiment, receives pulse width modulation (PWM) data representative of which of the LED strings 605-607 are to be activated and at what times during a corresponding PWM cycle, and the LED driver 604 is configured to individually activate the LED strings 605-607 at the appropriate times in their respective PWM cycles based on the PWM data 634.

The feedback controller 632, in one embodiment, includes a code generation module 618, a code processing module 620, a control digital-to-analog converter (DAC) 622, and an error amplifier (or comparator) 624, and receives tail voltage inputs from a set of current regulators (e.g., current regulators 615, 616, and 617). In the example of FIG. 6, the current regulator 615 is configured to maintain the current $I_1$ flowing through the LED string 605 at or near a target current (e.g., 30 mA) when active. Likewise, the current regulators 616 and 617 are configured to maintain the current $I_2$ flowing through the LED string 606 when active and the current $I_n$ flowing through the LED string 607 when active, respectively, at or near the target current. The current control modules 625, 626, and 627 are configured to activate or deactivate the LED strings 605, 606, and 607, respectively, via the corresponding current regulators.

The data/timing controller 628 receives the PWM data 634 and is configured to provide control signals to the other components of the LED driver 604 based on the timing and activation information represented by the PWM data 634. To illustrate, the data/timing controller 628 provides control signals $C_1$, $C_2$, and $C_n$ to the current control modules 625, 626, and 627, respectively, to control which of the LED strings 605-607 are active during corresponding portions of their respective PWM cycles. The data/timing controller 628 also provides control signals to the code generation module 618, the code processing module 620, and the control DAC 622 so as to control the operation and timing of these components. Further, as described above, the data/timing controller 628 receives the video data 636 and generates a frame timing reference 638 (corresponding to the frame timing reference 138, FIG. 1) based on the frame rate information included in the video data 636. The data/timing controller 628 can be implemented as hardware, software executed by one or more processors, or a combination thereof To illustrate, the data/timing controller 628 can be implemented as a logic-based hardware state machine.

The update controller 630 is configured to generate an update reference 640 (corresponding to the update reference 140, FIG. 1) based on the frame rate and timing information represented by the frame timing reference 638 as described above. Alternately, as also described above, the update controller 630 can be configured to generate a virtual frame timing reference approximating or otherwise representing the expected frame rate (or expected maximum frame rate) of the video data 636 and use this virtual frame timing reference to generate the update reference as a harmonic or subharmonic of the virtual frame rate, or the virtual frame timing reference can be provided directly as the update reference 640. The update controller 630 provides the update reference 640 to one or more of the code generation module 618, the code processing module 620, and the control DAC 622 so as to control the timing and initiation of the periodic voltage update process performed by these components.

The code generation module 618 includes a plurality of tail inputs coupled to the tail ends of the LED strings 605-607 to receive the tail voltages $V_{T1}$, $V_{T2}$, and $V_{Tn}$ of the LED strings 605, 606, and 607, respectively, and an output to provide a code value $C_{min}$_min. In at least one embodiment, the code generation module 618 is configured to identify or detect the minimum, or lowest, tail voltage of the LED strings 605-607 that occurs over a PWM cycle, image frame display period, or other specified update period and generate the digital code value $C_{min}$_min based on the identified minimum tail voltage. In the disclosure provided herein, the following nomenclature is used: the minimum of a particular measured characteristic over an update period or other specified duration is identified with the subscript "$\min_{13}$ min", thereby indicating it is the minimum over a specified time span; whereas the minimum of a particular measured characteristic at a given point in time or sample point is denoted with the subscript "min." To illustrate, the minimum tail voltage of the LED strings 605-607 at any given point in time or sample point is identified as $V_{Tmin}$, whereas the minimum tail voltage of the LED strings 605-607 for a given update period (having one or more sample points) is identified as $V_{Tmin}$_min. Similarly, the minimum code value determined at a given point in time or sample point is identified as $C_{min}$, whereas the minimum code value for a given update period (having one or more sample points) is identified as $C_{min}$_min.

The code generation module 618 can include one or more of a string select module 631, a minimum detect module 633, and an analog-to-digital converter (ADC) 635. As described in greater detail below with reference to FIGS. 9 and 10, the string select module 631 is configured to output the minimum tail voltage $V_{Tmin}$ of the LED strings 605-607 (which can vary over the update period), the ADC 635 is configured to convert the magnitude of the minimum tail voltage $V_{Tmin}$ output by the string select module 631 to a corresponding code value $C_{min}$ for each of a sequence of conversion points in the update period, the minimum detect module 633 is configured as a digital component to detect the minimum code value $C_{min}$ from the plurality of code values $C_{min}$ generated over the update period as the minimum code value $C_{min}$_min for the update period.

The code processing module 620 includes an input to receive the code value $C_{min}$_min and an output to provide a code value $C_{reg}$ based on the code value $C_{min}$_min and either a previous value for $C_{reg}$ from a previous update period or an initialization value. As the code value $C_{min}$_min represents the minimum tail voltage $V_{Tmin}$_min that occurred during the update period for all of the LED strings 605-607, the code processing module 620, in one embodiment, compares the code value $C_{min}$_min to a threshold code value, $C_{thresh}$, and generates a code value $C_{reg}$ based on the comparison. The code processing module 620 can be implemented as hardware, software executed by one or more processors, or a combination thereof. To illustrate, the code processing module 620 can be implemented as a logic-based hardware state machine, software executed by a processor, and the like. An example implementation of the code generation module 618 and the code processing module 620 is described in greater detail with reference to FIGS. 9 and 10.

In certain instances, none of the LED strings 605-607 may be enabled for a given update period. Thus, to prevent an erroneous adjustment of the output voltage $V_{OUT}$ when all LED strings are disabled, in one embodiment the data/timing controller 628 signals the code processing module 620 to suppress any updated code value $C_{reg}$ determined during a update period in which all LED strings are disabled, and instead use the code value $C_{reg}$ from the previous update period.

The control DAC 622 includes an input to receive the code value $C_{reg}$ and an output to provide a regulation voltage $V_{reg}$ representative of the code value $C_{reg}$. The regulation voltage $V_{reg}$ is provided to the error amplifier 624. The error amplifier 624 also receives a feedback voltage $V_{fb}$ representative of the output voltage $V_{OUT}$. In the illustrated embodiment, a voltage divider 626 implemented by resistors 627 and 629 is used to generate the voltage $V_{fb}$ from the output voltage $V_{OUT}$. The error amplifier 624 compares the voltage $V_{fb}$ and the voltage $V_{reg}$ and configures a signal ADJ based on this comparison. The voltage source 612 receives the signal ADJ and adjusts the output voltage $V_{OUT}$ based on the magnitude of the signal ADJ.

There may be considerable variation between the voltage drops across each of the LED strings 605-607 due to static variations in forward-voltage biases of the LEDs 608 of each LED string and dynamic variations due to the on/off cycling of the LEDs 608. Thus, there may be significant variance in the bias voltages needed to properly operate the LED strings 605-607. However, rather than drive a fixed output voltage $V_{OUT}$ that is substantially higher than what is needed for the smallest voltage drop as this is handled in conventional LED drivers, the LED driver 604 illustrated in FIG. 6 utilizes a feedback mechanism that permits the output voltage $V_{OUT}$ to be adjusted so as to reduce or minimize the power consumption of the LED driver 604 in the presence of variances in voltage drop across the LED strings 605-607, as described below with reference to the methods 700 and 800 of FIG. 7 and FIG. 8, respectively. In at least one embodiment, this feedback mechanism is triggered by the update reference 640 so as to synchronize the updating of the output voltage with the frame rate of the video data 636.

Figure 7:
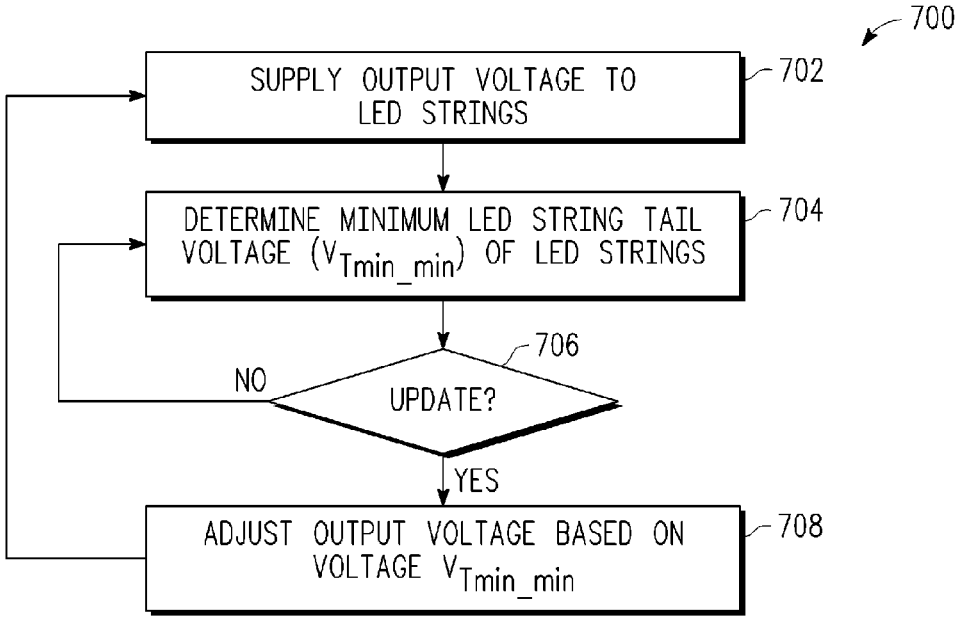
FIG. 7 is a flow diagram illustrating a method of operation of the LED system of FIG. 6 in accordance with at least one embodiment of the present disclosure.

FIG. 7 illustrates an example method 700 of operation of the LED system 600 in accordance with at least one embodiment of the present disclosure. At block 702, the voltage source 612 provides an initial output voltage $V_{OUT}$. As the PWM data 634 is received, the data/timing controller 628 configures the control signals $C_1$, $C_2$, and $C_n$ so as to selectively activate the LED strings 605-607 at the appropriate times of their respective PWM cycles. Over the course of an update period, the code generation module 618 determines the minimum detected tail voltage ($V_{Tmin}$_min) for the LED tails 605-607 at block 704.

At block 706, the feedback controller 632 determines whether to update the output voltage $V_{OUT}$. In one embodiment, the feedback controller 632 can perform the update process every time the update reference 640 is asserted. Alternately, as described above, it may be appropriate to ensure that the last adjustment to the output voltage $V_{OUT}$ has sufficiently settled, and thus the feedback controller 632 may disregard one or more assertions of the update reference 640 until a sufficient settling period has passed before initiating the next adjustment to the output voltage $V_{OUT}$. If no adjustment is to be made, the feedback controller 632 continues to monitor the tail voltages at block 704. Otherwise, at block 708 the feedback controller 632 configures the signal ADJ based on the voltage $V_{Tmin\ min}$ to adjust the output voltage $V_{OUT}$, which in turn adjusts the tail voltages of the LED strings 605-607 so that the minimum tail voltage $V_{Tmin}$ of the LED strings 605-607 is closer to a predetermined threshold voltage. The process of blocks 702-706 can be repeated for the next cycle of the update reference 140, and so forth.

As a non-zero tail voltage for a LED string indicates that more power is being used to drive the LED string than is absolutely necessary, it typically is advantageous for power consumption purposes for the feedback controller 632 to manipulate the voltage source 612 to adjust the output voltage $V_{OUT}$ until the minimum tail voltage $V_{Tmin}$_min would be approximately zero, thereby eliminating nearly all excess power consumption that can be eliminated without disturbing the proper operation of the LED strings. Accordingly, in one embodiment, the feedback controller 632 configures the signal ADJ so as to reduce the output voltage $V_{OUT}$ by an amount expected to cause the minimum tail voltage $V_{Tmin}$_min of the LED strings 605-607 to be at or near zero volts.

However, while being advantageous from a power consumption standpoint, having a near-zero tail voltage on a LED string introduces potential problems. As one issue, the current regulators 615-117 may need non-zero tail voltages to operate properly. Further, it will be appreciated that a near-zero tail voltage provides little or no margin for spurious increases in the bias voltage needed to drive the LED string resulting from self-heating or other dynamic influences on the LEDs 608 of the LED strings 605-607. Accordingly, in at least one embodiment, the feedback controller 632 can achieve a suitable compromise between reduction of power consumption and the response time of the LED driver 604 by adjusting the output voltage $V_{OUT}$ so that the expected minimum tail voltage of the LED strings 605-607 is maintained at or near a non-zero threshold voltage $V_{thresh}$ that represents an acceptable compromise between PWM response time and reduced power consumption. The threshold voltage $V_{thresh}$ can be implemented as, for example, a voltage between 0.2 V and 1 V (e.g., 0.5 V).

Figure 8:
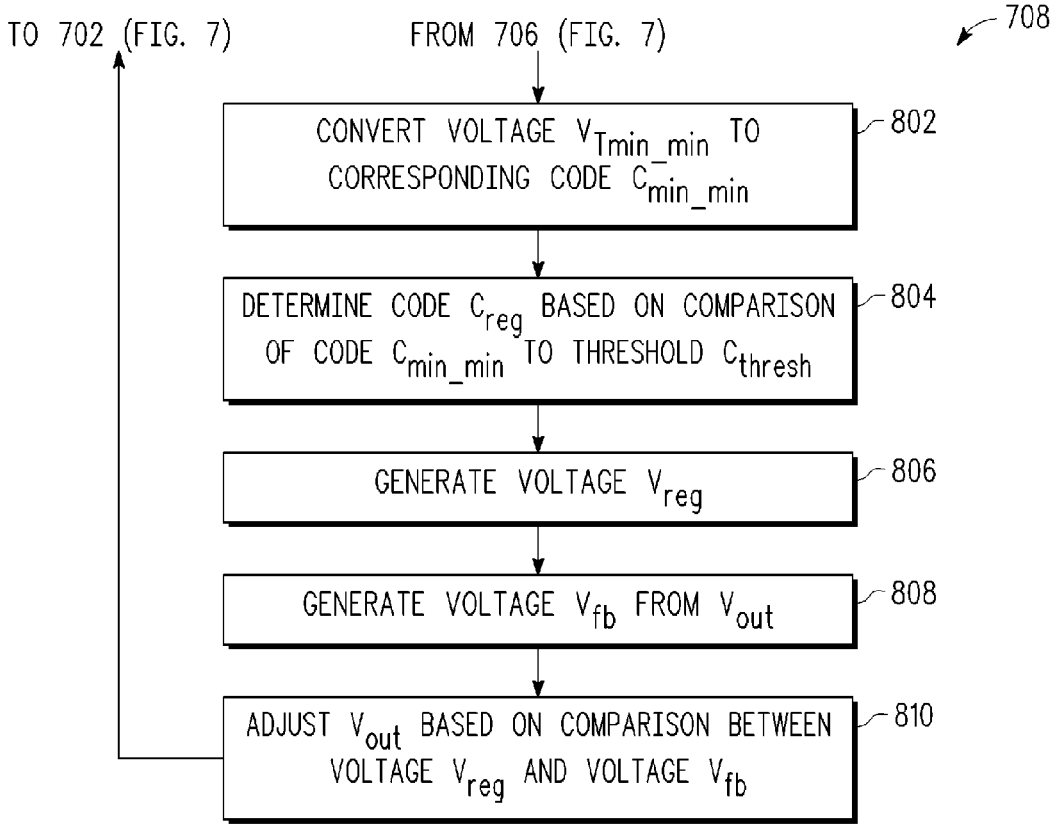
FIG. 8 is a flow diagram illustrating the method of FIG. 7 in greater detail in accordance with at least one embodiment of the present disclosure.

FIG. 8 illustrates a particular implementation of the process represented by block 708 of the method 700 of FIG. 7 in accordance with at least one embodiment of the present disclosure. As described above, at block 706 (FIG. 7) of the method 700, the code generation module 618 monitors the tail voltages $V_{T1}$, $V_{T2}$, and $V_{Tn}$ of the LED tails 605-607 to identify the minimum detected tail voltage $V_{Tmin}$_min in for a period measured by the update reference 640. In response to an assertion of the update reference 640 marking the end of this period, at block 802 the code generation module 618 converts the voltage $V_{Tmin}$_min to a corresponding digital code value $C_{min}$_min. Thus, the code value $C_{min}$_min is a digital value representing the minimum tail voltage $V_{Tmin}$_min detected during the preceding period. As described in greater detail herein, the detection of the minimum tail voltage $V_{Tmin}$_min can be determined in the analog domain and then converted to a digital value, or the detection of the minimum tail voltage $V_{Tmin}$_min can be determined in the digital domain based on the identification of the minimum code value $C_{min}$_min from a plurality of code values $C_{min}$ representing the minimum tail voltage $V_{Tmin}$ at various points over the period.

At block 804, the code processing module 620 compares the code value $C_{min}$_min with a code value $C_{thresh}$ to determine the relationship of the minimum tail voltage $V_{Tmin}$_min (represented by the code value $C_{min}$_min) to the threshold voltage $V_{thresh}$ (represented by the code value $C_{thresh}$). As described above, the feedback controller 632 is configured to control the voltage source 612 so as to maintain the minimum tail voltage of the LED strings 605-607 at or near a threshold voltage $V_{thresh}$ during the corresponding period marked by the update reference 640. The voltage $V_{thresh}$ can be at or near zero volts to maximize the reduction in power consumption or it can be a non-zero voltage (e.g., 0.5 V) so as to comply with current regulation requirements while still reducing power consumption.

The code processing module 620 generates a code value $C_{reg}$ based on the relationship of the minimum tail voltage $V_{Tmin}$_min to the threshold voltage $V_{thresh}$ revealed by the comparison of the code value $C_{min}$_min to the code value $C_{thresh}$. As described herein, the value of the code value $C_{reg}$ affects the resulting change in the output voltage $V_{OUT}$. Thus, when the code value $C_{min}$_min is greater than the code value $C_{thresh}$, a value for $C_{reg}$ is generated so as to reduce the output voltage $V_{OUT}$, which in turn is expected to reduce the minimum tail voltage $V_{Tmin}$_min closer to the threshold voltage $V_{thresh}$. To illustrate, the code processing module 620 compares the code value $C_{min}$_min to the code value $C_{thresh}$. If the code value $C_{min}$_min is less than the code value $C_{thresh}$, an updated value for $C_{reg}$ is generated so as to increase the output voltage $V_{OUT}$, which in turn is expected to increase the minimum tail voltage $V_{Tmin}$_min closer to the threshold voltage $V_{thresh}$. Conversely, if the code value $C_{min}$_min is greater than the code value $C_{thresh}$, an updated value for $C_{reg}$ is generated so as to decrease the output voltage $V_{OUT}$, which in turn is expected to decrease the minimum tail voltage $V_{Tmin}$_min closer to the threshold voltage $V_{thresh}$. To illustrate, the updated value for $C_{reg}$ can be set to $$C_{reg}(\text{updated}) = C_{reg}(\text{current}) + offset1 \quad \text{EQ. 1}$$

$$offset1 = \frac{R_{f2}}{R_{f1} + R_{f2}} \times \frac{(C_{thresh} - C_{min_min})}{\text{Gain_ADC} \times \text{Gain_DAC}} \quad \text{EQ. 2}$$

whereby $R_{f1}$ and $R_{f2}$ represent the resistances of the resistor 627 and the resistor 629, respectively, of the voltage divider 626 and Gain_ADC represents the gain of the ADC (in units code per volt) and Gain_DAC represents the gain of the control DAC 622 (in unit of volts per code). Depending on the relationship between the voltage $V_{Tmin}$_min and the voltage $V_{thresh}$ (or the code value $C_{min}$_min and the code value $C_{thresh}$), the offset1 value can be either positive or negative.

Alternately, when the code $C_{min}$_min indicates that the minimum tail voltage $V_{Tmin}$_min is at or near zero volts (e.g., $C_{min}$_min=0) the value for updated $C_{reg}$ can be set to $$C_{reg}(\text{updated}) = C_{reg}(\text{current}) + \text{offset2} \quad \text{EQ. 3}$$

whereby offset2 corresponds to a predetermined voltage increase in the output voltage $V_{OUT}$ (e.g., 1 V increase) so as to affect a greater increase in the minimum tail voltage $V_{Tmin}$_min.

At block 806, the control DAC 622 converts the updated code value $C_{reg}$ to its corresponding updated regulation voltage $V_{reg}$. At block 808, the feedback voltage $V_{fb}$ is obtained from the voltage divider 626. At block 810, error amplifier 624 compares the voltage $V_{reg}$ and the voltage $V_{fb}$ and configures the signal ADJ so as to direct the voltage source 612 to increase or decrease the output voltage $V_{OUT}$ depending on the result of the comparison as described above. The process of blocks 802-810 can be repeated for the next period marked by the update reference 640, and so forth.

Figure 9:
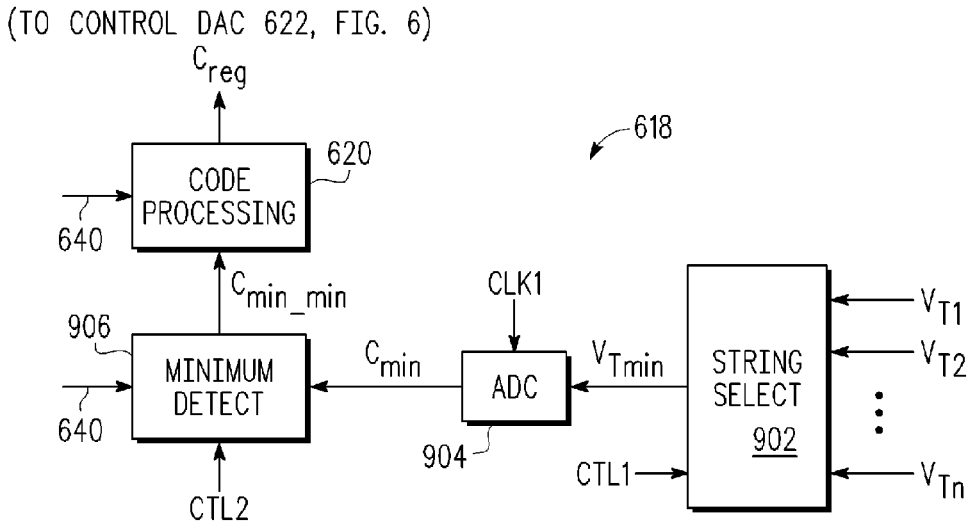
FIG. 9 is a diagram illustrating an example implementation of a feedback controller of the LED system of FIG. 6 in accordance with at least one embodiment of the present disclosure.

FIG. 9 illustrates a particular implementation of the code generation module 618 and the code processing module 620 of the LED driver 604 of FIG. 6 in accordance with at least one embodiment of the present disclosure. In the illustrated embodiment, the code generation module 618 includes an analog string select module 902 (corresponding to the string select module 631, FIG. 6), an analog-to-digital converter (ADC) 904 (corresponding to the ADC 635, FIG. 6), and a digital minimum detect module 906 (corresponding to the minimum detect module 633, FIG. 6). The analog string select module 902 includes a plurality of inputs coupled to the tail ends of the LED strings 605-607 (FIG. 6) so as to receive the tail voltages $V_{T1}$, $V_{T2}$, and $V_{Tn}$. In one embodiment, the analog string select module 902 is configured to provide the voltage $V_{Tmin}$ that is equal to or representative of the lowest tail voltage of the active LED strings at the corresponding point in time of an update period marked by the update reference 640. That is, rather than supplying a single voltage value at the conclusion of the period, the voltage $V_{Tmin}$ output by the analog string select module 902 varies throughout the update period as the minimum tail voltage of the LED strings changes at various points in time of the update period.

The analog string select module 902 can be implemented in any of a variety of manners. For example, the analog string select module 902 can be implemented as a plurality of semiconductor p-n junction diodes, each diode coupled in a reverse-polarity configuration between a corresponding tail voltage input and the output of the analog string select module 902 such that the output of the analog string select module 902 is always equal to the minimum tail voltage $V_{Tmin}$ where the offset from voltage drop of the diodes (e.g., 0.5 V or 0.7 V) can be compensated for using any of a variety of techniques.

The ADC 904 has an input coupled to the output of the analog string select module 902, an input to receive a clock signal CLK1, and an output to provide a sequence of code values $C_{min}$ over the course of the update period based on the magnitude of the minimum tail voltage $V_{Tmin}$ at respective points in time of the update period (as clocked by the clock signal CLK1). The number of code values $C_{min}$ generated over the course of the update period depends on the frequency of the clock signal CLK1.

The digital minimum detect module 906 includes an input to receive the sequence of code values $C_{min}$ generated over the course of the update period by the ADC 904 and an input to receive the update reference 640. As the code values $C_{min}$ are received, the digital minimum detect module 906 determines the minimum, or lowest, of these code values. To illustrate, the digital minimum detect module 906 can include, for example, a buffer, a comparator, and control logic configured to overwrite a code value $C_{min}$ stored in the buffer with an incoming code value $C_{min}$ if the incoming code value $C_{min}$ is less than the one in the buffer. In response to an assertion of the update reference 640, the digital minimum detect module 906 provides the minimum code value $C_{min}$ of the series of code values $C_{min}$ for the update period as the code value $C_{min}$_min to the code processing module 620. In response to receiving the code value $C_{min}$_min and in response to the assertion of the update reference 640, the code processing module 620 compares the code value $C_{min}$_min to the predetermined code value $C_{thresh}$ and generates an updated code value $C_{reg}$ based on the comparison as described in greater detail above with reference to block 804 of FIG. 8.

Figure 10:
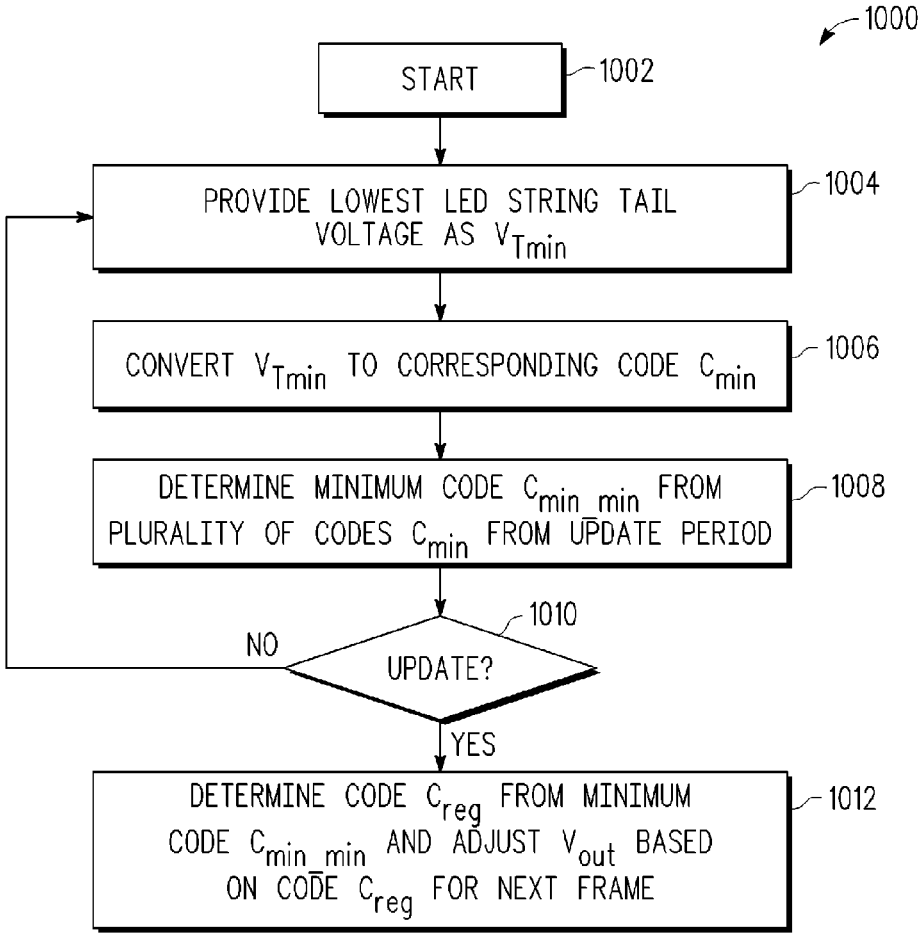
FIG. 10 is a flow diagram illustrating a method of operation of the example implementation of FIG. 9 in accordance with at least one embodiment of the present disclosure.

FIG. 10 illustrates an example method 1000 of operation of the implementation of the LED system 600 illustrated in FIGS. 6 and 9 in accordance with at least one embodiment of the present disclosure. At block 1002, an update period starts, as indicated by an assertion of the update reference 640 (FIG. 6). At block 1004, the analog string select module 902 provides the minimum tail voltage of the LED strings at a point in time of the update period as the voltage $V_{Tmin}$ for that point in time. At block 1006, the ADC 904 converts the voltage $V_{Tmin}$ to a corresponding code value $C_{min}$ and provides it to the digital minimum detect module 906 for consideration as the minimum code value $C_{min}$_min for the update period thus far at block 1008. At block 1010, the update controller 630 determines whether a new update period has started, i.e., whether the update reference 640 has been asserted a second time, thereby marking an end of the previous update period and the start of the next one. The code processing unit 620 as part of the feedback controller 132 determines whether there is a need to do an update based on the condition of other operating parameters of the LED drivers and whether sufficient settling period has occurred since the last adjustment to the output voltage $V_{OUT}$, if appropriate. If no need to update, the process of blocks 1004-1008 is repeated to generate another code value $C_{min}$. Otherwise, an update is initiated and the minimum code value $C_{min}$ of the plurality of code values $C_{min}$ generated during the previous update period is provided as the code value $C_{min}$_min by the digital minimum detect module 906. In an alternate embodiment, the plurality of code values $C_{min}$ generated during the previous update period are buffered and then the minimum value $C_{min}$_min is determined at the end of the previous update period from the plurality of buffered code values $C_{min}$. At block 1012 the code processing module 620 uses the minimum code value $C_{min}$_min to generate an updated code value $C_{reg}$ based on a comparison of the code value $C_{min}$_min to the predetermined code value $C_{thresh}$. The control DAC 622 uses the updated code value $C_{reg}$ to generate the corresponding voltage $V_{reg}$, which is used by the error amplifier 624 along with the voltage $V_{fb}$ to adjust the output voltage $V_{OUT}$ for the current update period as described above.

Figure 11:
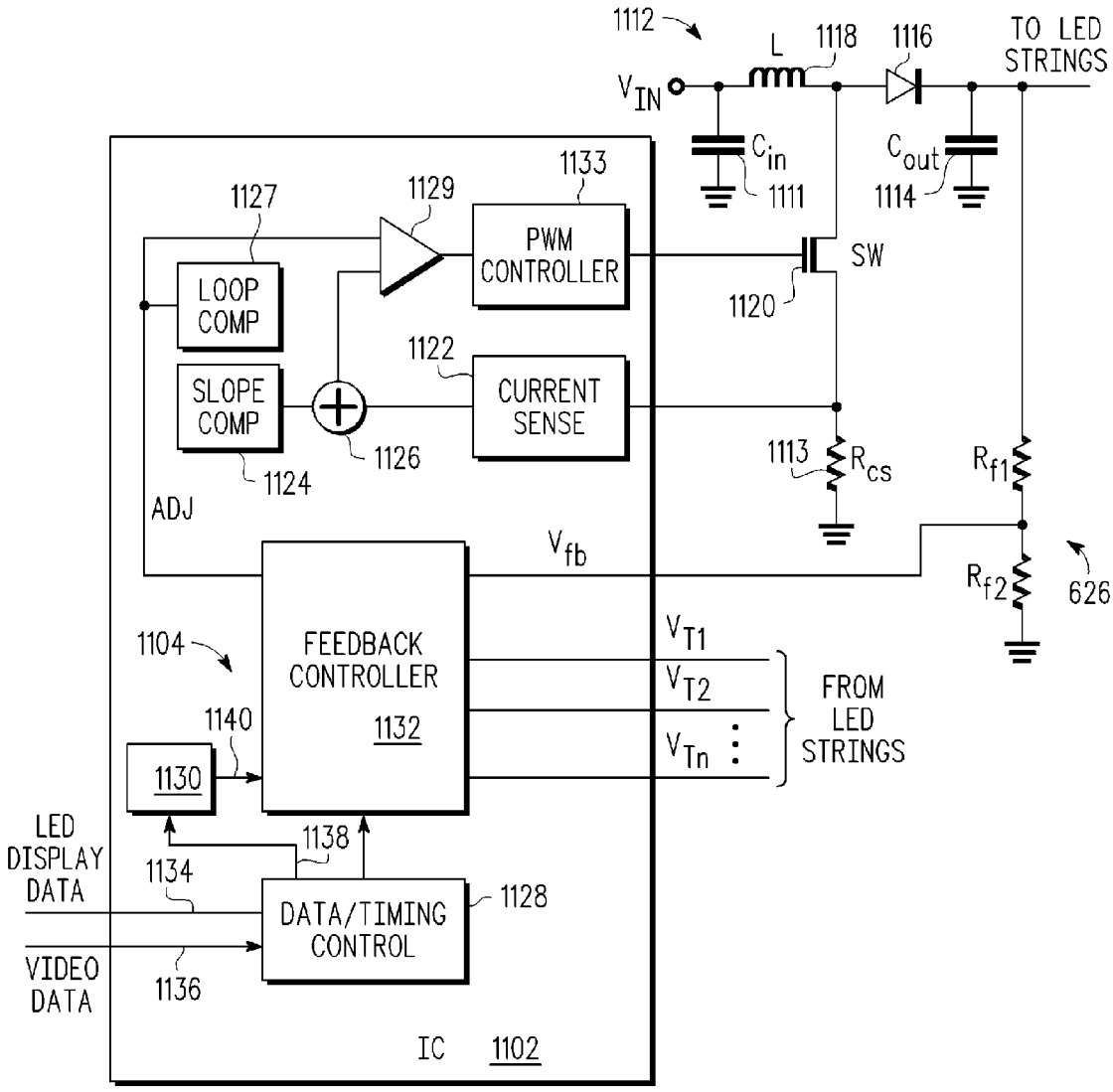
FIG. 11 is a diagram illustrating an integrated circuit (IC)-based implementation of the LED systems of FIGS. 1 and 6 in accordance with at least one embodiment of the present disclosure.

FIG. 11 illustrates an IC-based implementation of the LED system 100 of FIG. 1 or the LED system 600 of FIG. 6 as well as an example implementation of a voltage source 1112 in accordance with at least one embodiment of the present disclosure. In the depicted example, an LED driver 1104 (corresponding to either the LED driver 104 of FIG. 1 or the LED driver 604 of FIG. 6) is implemented as an integrated circuit (IC) 1102 having a data/timing controller 1128, an update controller 1130 and a feedback controller 1132, that operate on video data 1136 (corresponding to video data 136, FIG. 1) and LED display data 1134 (corresponding to LED display data 134, FIG. 1) to generate a frame timing reference 1138 (corresponding to frame timing reference 138, FIG. 1) and an update reference 1140 (corresponding to update reference 140, FIG. 1), as described above. As also illustrated, some or all of the components of the voltage source 1112 can be implemented at the IC 1202. In one embodiment, the voltage source 1112 can be implemented as a step-up boost converter, a buck-boost converter, and the like. To illustrate, the voltage source 1112 can be implemented with an input capacitor 1111, a resistor 1113, an output capacitor 1114, a diode 1116, an inductor 1118, a switch 1120, a current sense block 1122, a slope compensator 1124, an adder 1126, a loop compensator 1127, a comparator 1129, and a PWM controller 1133 connected and configured as illustrated in FIG. 11.

The term "another", as used herein, is defined as at least a second or more. The term "subset," as used herein, is defined as one or more of a larger set, inclusive. The terms "including", "having", or any variation thereof, as used herein, are defined as comprising. The term "coupled", as used herein with reference to electro-optical technology, is defined as connected, although not necessarily directly, and not necessarily mechanically.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

providing an output voltage to a head end of at least one light emitting diode (LED) string;

providing a frame timing reference based on a frame rate of a series of image frames to be displayed; and adjusting the output voltage responsive to the frame timing reference, the adjusting comprising:

determining, at a first time identified based on the frame timing reference, a first relationship between a first value of an operating parameter of the at least one LED string and a predetermined threshold associated with the operating parameter; and adjusting, at a second time subsequent to the first time, the output voltage based on the first relationship.

2. The method of claim 1, wherein adjusting the output voltage responsive to the frame timing reference comprises:

in response to an adjustment trigger associated with the frame timing reference:

initiating an adjustment to the output voltage responsive to determining a previous adjustment to the output voltage has sufficiently settled; and avoiding initiation of an adjustment to the output voltage responsive to determining the previous adjustment to the output voltage has not sufficiently settled.

3. The method of claim 2, further comprising:

adjusting the output voltage responsive to the frame timing reference further comprises adjusting the output voltage responsive to a value of an operating parameter associated with the at least one LED string; and the method further comprising determining whether the previous adjustment to the output voltage has sufficiently settled based on a duration over which the value of the operating parameter is determined.

4. The method of claim 1, wherein adjusting the output voltage responsive to the frame timing reference comprises adjusting the output voltage responsive to an update reference having a frequency that is one of a harmonic of the frame rate or a subharmonic of the frame rate.

5. The method of claim 1, providing the frame timing reference comprises generating the frame timing reference as a virtual frame timing reference representative of the frame rate of the video data.

6. The method of claim 5, further comprising:

dynamically adjusting the virtual frame timing reference responsive to expected changes in the frame rate of the video data.

7. The method of claim 1, further comprising:

determining, at a third time identified based on the frame timing reference, a second relationship between a second value of the operating parameter and the predetermined threshold, the third time subsequent to the second time; and adjusting, at a fourth time subsequent to the third time, the output voltage based on the second relationship.

8. The method of claim 1, wherein:

the at least one LED string comprises a plurality of LED strings;

each LED string of the plurality of LED strings has a corresponding tail voltage responsive to the output voltage;

the operating parameter comprises a minimum tail voltage of the tail voltages of the plurality of LED strings; and the predetermined threshold comprises a target voltage for the minimum tail voltage.

9. The method of claim 1, wherein:

the operating parameter comprises a magnitude of the output voltage; and the predetermined threshold comprises a target magnitude for the output voltage.

10. A method comprising:

providing an output voltage to a head end of each of a plurality of light emitting diode (LED) strings, each LED string having a corresponding tail voltage responsive to the output voltage;

providing a frame timing reference based on a frame rate of a series of image frames to be displayed; and responsive to the frame timing reference:

determining a minimum tail voltage of the plurality of LED strings;

increasing the output voltage in response to determining the minimum tail voltage is less than a predetermined threshold voltage; and decreasing the output voltage in response to determining the minimum tail voltage is greater than the predetermined threshold voltage.

11. The method of claim 10, wherein:

determining the minimum tail voltage of the plurality of LED strings comprises determining a minimum tail voltage of the plurality of LED strings for a duration of a display of a first image frame of the series of images frames; and adjusting the output voltage based on the minimum tail voltage comprises adjusting the output voltage based on the minimum tail voltage in response to a start of a display of a second image frame, the second image frame following the first image frame in the series of image frames.

12. The method of claim 10, further comprising:

generating a first code value based on the minimum tail voltage;

generating a second code value based on a comparison of the first code value to a third code value, the third code value representing a predetermined threshold voltage for tail voltages of the plurality of LED strings;

generating a first voltage based on the second code value;

determining a second voltage representative of the output voltage; and adjusting the output voltage based on a relationship between the first voltage and the second voltage.

13. The method of claim 10, wherein providing the frame timing reference comprises generating the frame timing reference as a virtual frame timing reference representative of the frame rate of the video data.

14. A system comprising:

a voltage source configured to provide an adjustable output voltage to a head end of at least one light emitting diode (LED) string; and a LED driver configured to:

determine a frame timing reference based on a frame rate of a series of image frames to be displayed; and adjust the output voltage of the voltage source responsive to an adjustment trigger associated with the frame timing reference, the adjusting comprising:

initiating an adjustment to the output voltage responsive to determining a previous adjustment to the output voltage has sufficiently settled; and avoiding initiation of an adjustment to the output voltage responsive to determining the previous adjustment to the output voltage has not sufficiently settled.

15. The system of claim 14, wherein the LED driver further is configured to:

generate an update reference based on the frame timing reference and a previous update status of the output voltage; and wherein the LED driver is configured to adjust the output voltage of the voltage source responsive to the update reference.

16. The system of claim 14, wherein the LED driver is configured to determine the frame timing reference comprises generating a virtual frame timing reference representative of the frame rate of the video data.

17. The system of claim 16, wherein the LED driver further is configured to:

dynamically adjust the virtual frame timing reference responsive to expected changes in the frame rate of the video data.

18. The system of claim 14, wherein the LED driver further is configured to:

determine, at a first time determined based on the frame timing reference, a first relationship between a first value of an operating parameter of the at least one LED string and a predetermined threshold;

determine, at a second time determined based on the frame timing reference, a second relationship between a second value of the operating parameter and the predetermined threshold, the second time subsequent to the first time; and wherein the LED driver is configured to adjust the output voltage by:

adjusting, at a third time, the output voltage based on the first relationship, the third time subsequent to the first time and prior to the second time; and adjusting, at a fourth time, the output voltage based on the second relationship, the fourth time subsequent to the second time.

19. The system of claim 18, wherein:

the at least one LED string comprises a plurality of LED strings;

each LED string of the plurality of LED strings has a corresponding tail voltage responsive to the output voltage;

the operating parameter comprises a minimum tail voltage of the tail voltages of the plurality of LED strings; and the predetermined threshold comprises a target voltage for the minimum tail voltage.

20. The system of claim 18, wherein:

the operating parameter comprises a magnitude of the output voltage; and the predetermined threshold comprises a target magnitude for the output voltage.

* * * * *